US005975186A

United States Patent [19]

Day

[11] Patent Number: 5,975,186

[45] Date of Patent: Nov. 2, 1999

[54] ROLLER BLINDS MOUNTINGS

[76] Inventor: Perry Day, 226 St. Bernards Rd., Solihull, West Midlands, United Kingdom, B92 7BH

[21] Appl. No.: 09/035,498

[22] Filed: Mar. 5, 1998

[51] Int. Cl.[6] ..... A47G 5/02

[52] U.S. Cl. ..... 160/321; 160/178.1 R; 160/319; 160/323.1; 160/903

[58] Field of Search ..... 160/323.1, 321, 160/319, 903, 291, 307, 313, 324; 248/251–270, 221.11

[56] References Cited

U.S. PATENT DOCUMENTS

| | | | |
|---|---|---|---|
| 1,854,959 | 4/1932 | Schmelz | 160/307 |
| 1,923,506 | 8/1933 | Rice | 160/903 X |
| 4,009,745 | 3/1977 | Erpenbeck | 160/323.1 X |
| 4,224,974 | 9/1980 | Anderson et al. | 160/178 R |
| 4,323,105 | 4/1982 | Berman et al. | 160/319 X |
| 4,370,838 | 2/1983 | Vermillion | 52/36 |
| 4,519,487 | 5/1985 | Florin | 160/319 X |
| 4,729,418 | 3/1988 | Rude | 160/323.1 |
| 5,009,259 | 4/1991 | Miloslaus | 160/323.1 |
| 5,156,196 | 10/1992 | Corey et al. | 160/178.2 |
| 5,351,743 | 10/1994 | Jackson | 160/310 |
| 5,443,109 | 8/1995 | Benthin | 160/319 X |
| 5,488,983 | 2/1996 | Jung | 160/319 X |
| 5,669,432 | 9/1997 | Nisenson et al. | 160/321 X |
| 5,676,415 | 10/1997 | Ament et al. | 160/323.1 X |
| 5,813,449 | 9/1998 | Patmore | 160/323.1 X |

*Primary Examiner*—Daniel P. Stodola
*Assistant Examiner*—Bruce A. Lev
*Attorney, Agent, or Firm*—Ira S. Dorman

[57] ABSTRACT

The blind comprises a sheet wound on a tube which is supported at one end by a drive assembly and at the opposite end by an idle end mounting. The drive assembly is operated by a ball cord which is engaged over a flangeless pulley which, in turn, has an internal notch to pass over a braking spring. The idle end mounting includes a spring which holds the tube in position and which acts between a spigot and a shaft, both of which are keyed together. The spigot rotates on a drum which is mounted on a ribbed metal bracket, and a similar bracket supports the drive assembly.

26 Claims, 6 Drawing Sheets

ROLLER BLINDS MOUNTINGS

TECHNICAL FIELD OF THE INVENTION

This invention relates to roller blinds which comprise a blind or other sheet material wound on a tube or roller, and more particularly, to mounting brackets, drive assemblies and idle end mountings for use with roller blinds.

BACKGROUND

In roller blinds the tube is generally supported by brackets at both ends, one end being provided with drive assembly comprising a pull cord or like means by which the tube can be manually rotated, and the other end being provided with an idle end mounting.

SUMMARY OF THE INVENTION

The present invention proposes an idle end support for a roller blind of the kind comprising a sheet wound on a tube, the support comprising:

fixed portion, a hollow spigot for insertion into an end of said tube and mounted for rotation relative to the fixed portion, and spring means acting to urge the spigot away from the fixed portion.

The incorporation of a spring is advantageous since it assists in holding the roller blind in position in use. Furthermore, there is less requirement for precise positioning of the mounting brackets since the spring takes up any errors.

The spring means preferably acts between the spigot and a component that rotates therewith, so that any tendency of the spring to wind or unwind during rotation of the spigot is avoided.

The said component may comprise a shaft on which the spigot is axially slidable but which is keyed to the spigot for rotation therewith. The spring may thus be located about the shaft.

The shaft is preferably rotatably connected with the fixed portion.

The fixed portion preferably comprises a hollow cylindrical element, with the shaft rotatably mounted in one end thereof. The spigot is preferably closely and slidably received over said cylindrical element.

The invention further proposes an idle end support for a roller blind of the kind comprising a sheet wound on a tube, the support comprising:

a fixed portion, a shaft mounted for rotation relative to said fixed portion, a hollow spigot for insertion into an end of said tube and mounted on the shaft, said spigot being keyed to the shaft such that the spigot rotates with the shaft but is moveable axially of the shaft, and spring means acting between the shaft and spigot to urge the spigot along the shaft away from the fixed portion.

The invention also a roller blind mounting bracket which is formed from sheet metal and comprises a side wall, an end wall, and a connecting lug for connection with the roller blind, the end wall and the connecting lug projecting substantially perpendicularly from the side wall, in which the root of the lug at the junction between the lug and the side wall is formed into a non-linear configuration.

With such an arrangement there is a reduced risk of the lug twisting or shearing in use compared with existing brackets.

In a preferred form, the lug is formed with a rib which extends substantially perpendicularly from the root of the lug at the junction with the side wall. The rib may, for example, be of triangular shape, although an arcuate shape is stronger.

The invention also provides a roller blind mounting bracket which is formed from sheet metal and comprises a side wall and an end wall which projects substantially perpendicularly from the side wall, the side wall having means for connecting the bracket with the roller blind, in which the junction between the side wall and the end wall is formed into a non-linear configuration.

With such an arrangement there is less risk of the bracket bending and changing the angle between the side wall and the end wall.

In a preferred configuration the side wall and/or the end wall is formed with at least one rib which extends from the junction between the said walls.

Although the rib/s may be formed in just the side wall or the end wall, it is more important for the side wall to comprise such a rib or ribs to prevent it from bending in use. For optimum strength it is preferred to form ribs in both the side wall and the end wall.

The side wall preferably comprises a plurality of such ribs. Said ribs preferably extend to the opposite edge of the side wall.

Where the means for connecting the bracket with a roller blind comprises the form of connecting lug described above, the lug preferably extends from a substantially flat area of the side wall at the end of one of the ribs.

The ribs may be formed by a pressing or stamping operation during manufacture of the bracket.

The invention further provides a drive assembly for a roller having sheet material wound thereon, comprising:

a housing which is open in the direction of the roller and contains a shaft which projects therefrom;

a braking member which encircles the shaft, said braking member having a pair of circumferentially spaced ends;

a pulley which is rotatably mounted about the shaft within the housing and which includes a cylindrical portion located about the shaft and containing an axial slot, wall portions of the cylindrical member on opposite sides of the slot each being driveably engageable with a respective end of the braking member;

a spigot for connection with the roller received over said cylindrical portion and having projection means which is disposed within the said slot between said ends of the braking member; and a flexible drive element looped around the pulley for rotation thereof; the arrangement being such that rotation of the pulley by means of the drive element causes the cylindrical portion to act on the braking member causing it to release its grip on the shaft, such rotational movement being transmitted to the spigot via the projection means, and rotation of the spigot other than by the drive element causes the said projection means to act on the braking member such as to tighten its grip on the shaft and thereby resist rotation of the spigot;

in which the shaft carries bearing means for positively and rotatably locating the pulley thereon, said bearing means being of greater outside diameter than the portion of the shaft which receives the braking member, the pulley having an internal bearing surface for co-operation with the bearing means and which is configured such that the pulley can pass over the braking member during assembly thereof.

With such an arrangement the braking member can be placed over the shaft before the pulley, which makes it easier to fit the braking member and generally simplifies and speeds up assembly.

The bearing surface of the pulley may be provided by a central aperture which is substantially circular with a recess or recesses for passage of the ends of the braking member.

The bearing means may, for example, comprise a separate collar which is located about the shaft before the braking member. Preferably however, in order to simplify assembly and reduce the number of components, the shaft is stepped such that the bearing means is formed by an enlarged portion of the shaft.

There is preferably a substantial radial clearance between the outermost diameter of the pulley and the opposed wall of the housing, such that the drive element can be engaged with the pulley whilst the pulley is located in the housing. Such an arrangement further simplifies assembly, whilst the provision of the said bearing means ensures that the pulley is still constrained to rotate smoothly. The spigot preferably carries a radially projecting annular flange which substantially closes the housing. The flange may help to retain the drive element within the housing, provides the drive assembly with a neater appearance, and guards against the edge of sheet material rubbing against the pulley.

A preferred form of drive element comprises a series of balls. The pulley may be of substantially the same thickness as the diameter of the balls so that the drive cord is located in one axial direction by the wall of the housing and in the opposite direction by the flange of the spigot. This simplifies moulding of the pulley and allows a potential reduction in the overall thickness of the assembly.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
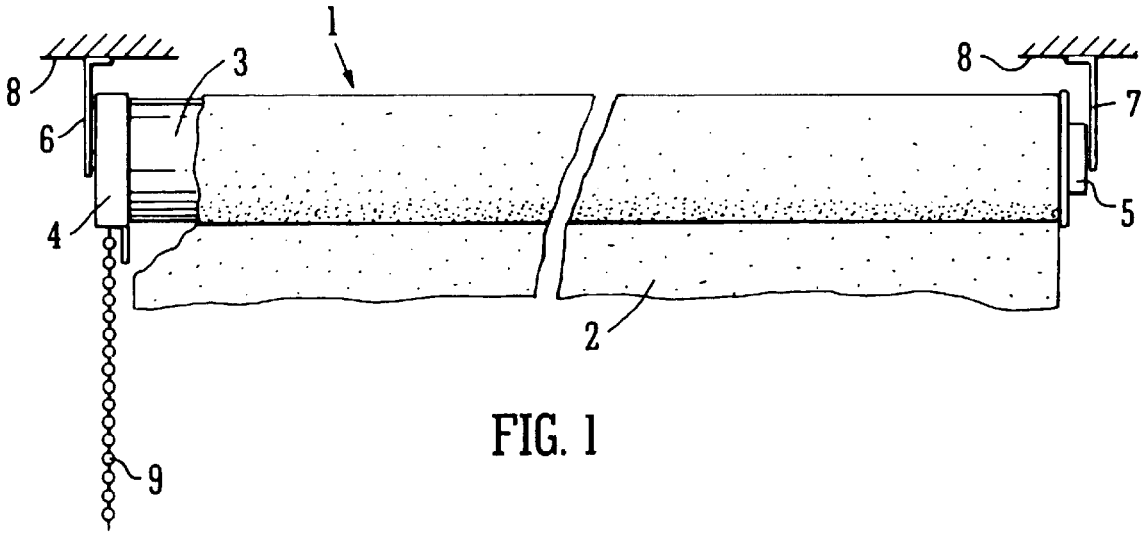
FIG. 1 is a general front view of a roller blind in accordance with the invention.

Referring firstly to FIG. 1, the roller blind 1 comprises a sheet of fabric material 2 which is wound upon a tube 3 supported at opposite ends by a drive assembly 4 and an idle end mounting 5. The drive assembly 4 and the idle end mounting 5 are in turn supported by a pair of identical mounting brackets 6 and 7 which, in the present case, are secured to a horizontal undersurface 8. As is conventional, the blind 2 can be unwound from the tube or rewound by means of a cord 9 which is suspended from the drive assembly 4.

Figure 2:
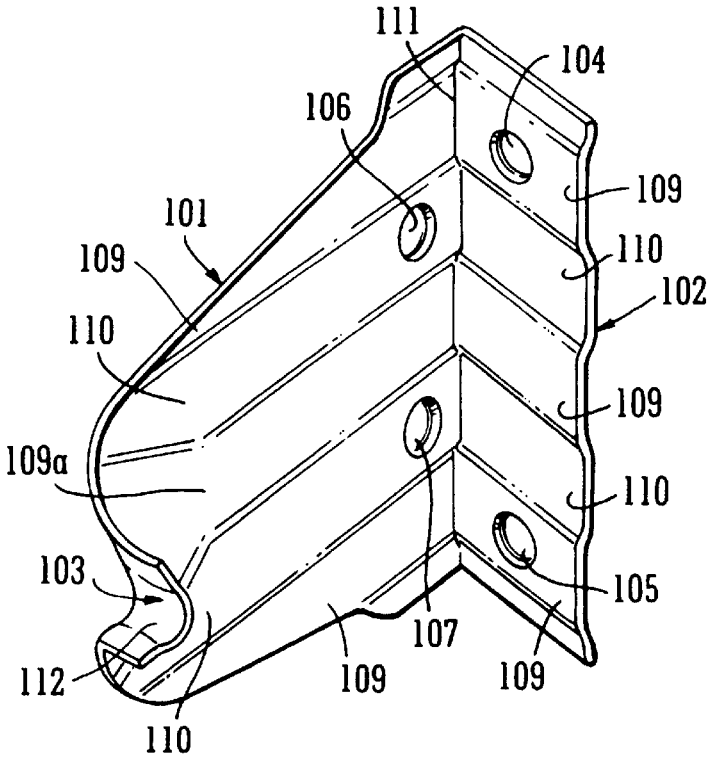
FIG. 2 is a general perspective view of one of the mounting brackets of the roller blind.

As shown in FIG. 2, each of the mounting brackets 6 and 7 is formed from a single piece of sheet metal by a pressing or stamping operation. In general, such brackets constitute one of the most expensive individual components in a roller blind assembly. Normally, in order to provide sufficient strength to prevent the bracket from bending in use, such brackets would require to be formed of substantially thicker metal than the present bracket. The present form of bracket allows the thickness of the metal to be reduced and the cost of the components reduced whilst still maintaining adequate strength.

The bracket comprises a side wall 101, an end wall 102, and a connecting lug 103 for connection with the roller blind. The end wall 102 and the lug 103 project in the same direction from opposite end edges of the side wall 101, both disposed substantially perpendicular to said side wall. As is conventional, the end wall 102 contains a pair of screw holes 104 and 105 for securing the bracket to a surface which extends generally parallel to the carrier tube for the blind such as a window frame or an undersurface 8 (FIG. 1) such as is found at the top of a window opening. The side wall 101 contains a second pair of screw holes 106 and 107 for use in situations where the blind must be secured between a pair of parallel surfaces such as the sides of a window opening.

The end wall 102 is formed into a series of shallow wave-like undulations, effectively forming three parallel ribs 109 on the internal side of the bracket which is adjacent to the blind in use, the ribs being separated by two shallow grooves 110. These ribs and grooves extend across the width of the end wall to meet the bend 111 between the end wall 102 and the side wall 101 substantially perpendicularly. The ribs and grooves continue beyond the bend 111 along the entire length of the side wall 101, again extending substantially perpendicular to the bend 111. Thus, the bend 111 is formed in a non-linear configuration. It will be noted that the central rib 109*a* becomes wider as it approaches the lug 103 so that the root of the lug meets a substantially flat area of the side wall 101.

The lug 103 is formed with a single rib 112 of arcuate cross-section which extends perpendicularly from the side wall 101 along the entire length of the lug. The opposed side edges of the lug on both sides of the rib 112 are slightly out-turned. The junction between the lug 103 and the side wall 101 is thus formed with a non-linear configuration.

Figure 3:
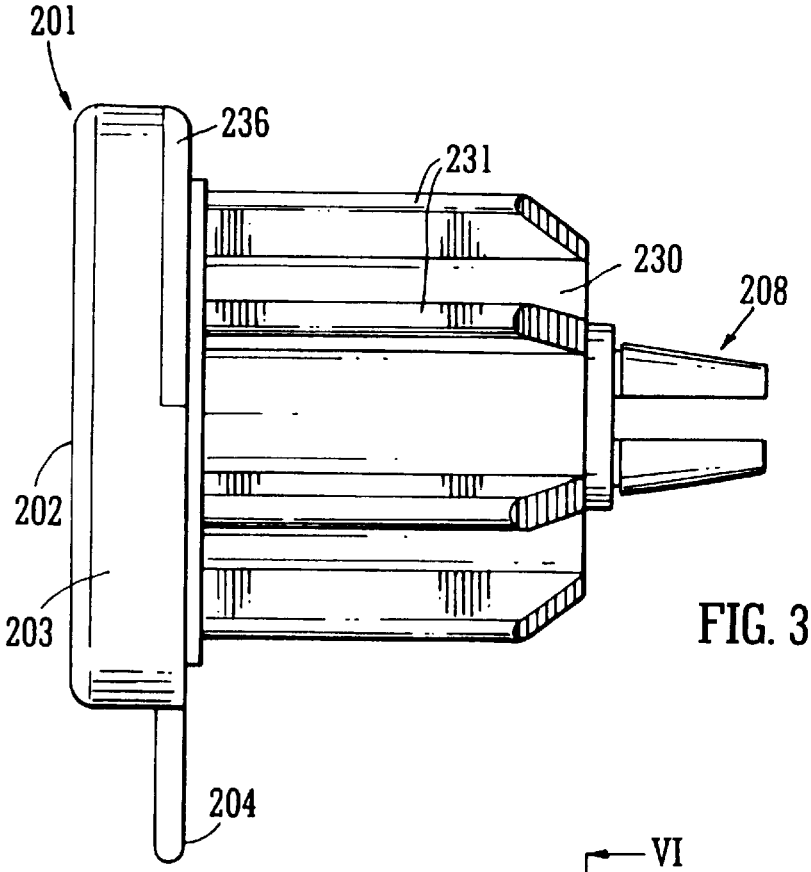
FIG. 3 is a side view of the drive assembly of the roller blind.
Figure 4:
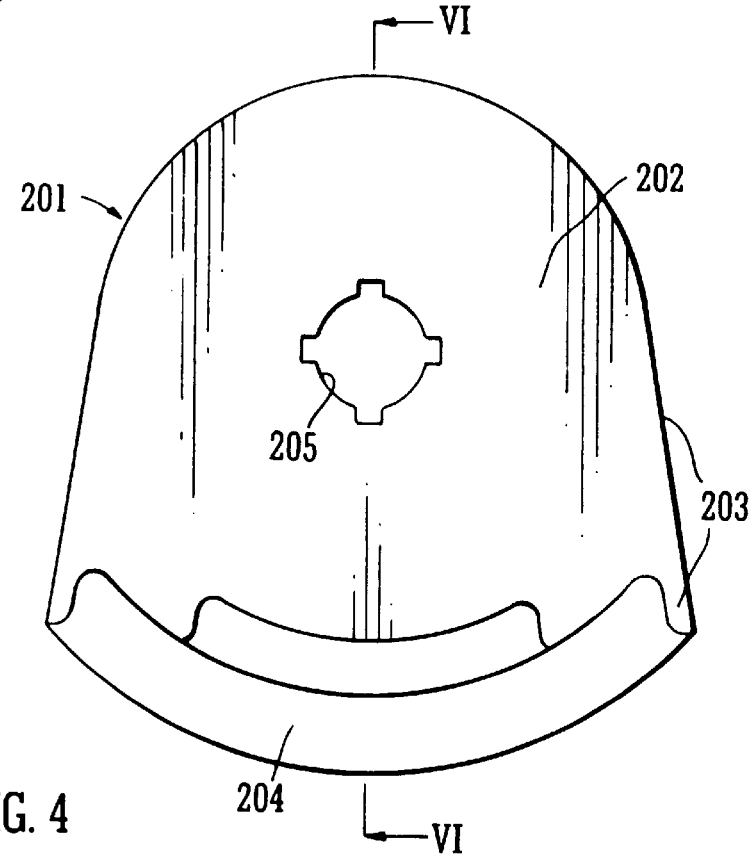
FIG. 4 is an end view of the drive assembly, as viewed from the left in FIG. 3.

Referring now to FIGS. 3 and 4, the drive assembly comprises a moulded plastics housing 201 which comprises a rear wall 202 and a side wall 203. The side wall 203 extends around the top and sides of the rear wall 202 but bottom of the housing is open, the side walls diverging downwardly to terminate a short distance below the rear wall 202. The front of the housing is open, although the lower ends of the side walls are joined at their front extremities by an arcuate fabric guard 204.

Figure 5:
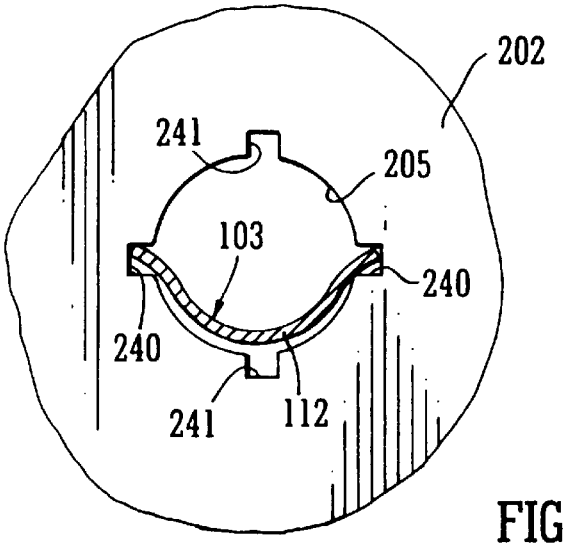
FIG. 5 is a detailed end view of part of the drive assembly showing, in cross section, part of the bracket engaged therewith.

The rear wall 202 contains a circular aperture 205 by which the housing may be non-rotatably engaged with the lug 103 of the mounting bracket 6. As shown in more detail in FIG. 5, the aperture 205 has two mutually perpendicular pairs of opposed notches 240 and 241, so that the rib 112 can be received in the circular portion 205 with the edges of the lug firmly located in a pair of the opposed notches 240. The other pair of notches 241 provide an alternative mounting position for the drive assembly for use when the bracket is secured to a vertical surface.

Figure 6:
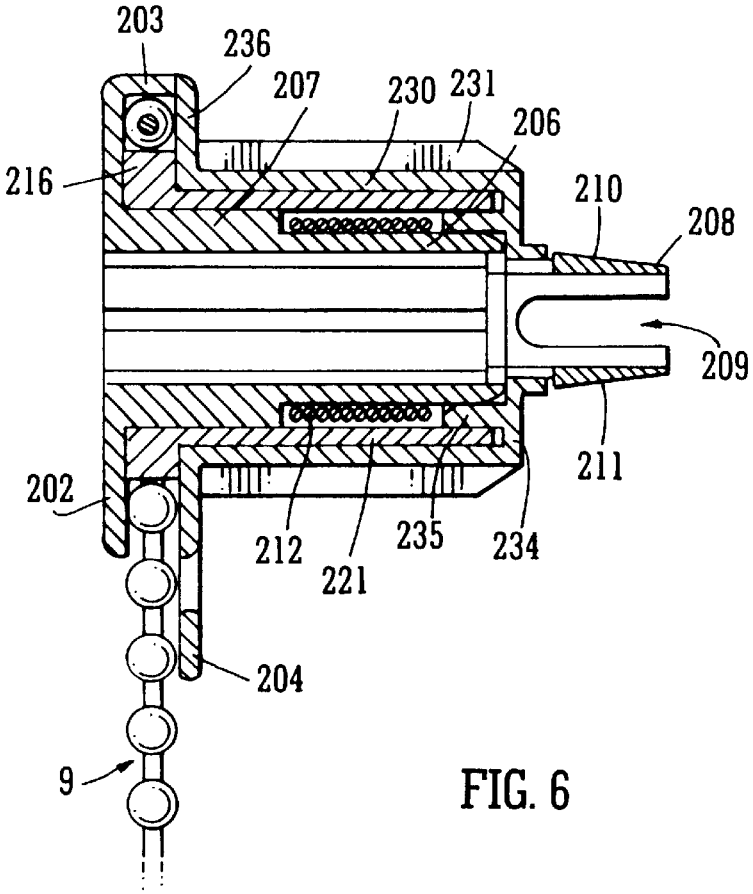
FIG. 6 is longitudinal section through the drive assembly on line VI—VI of FIG. 4.
Figure 7:
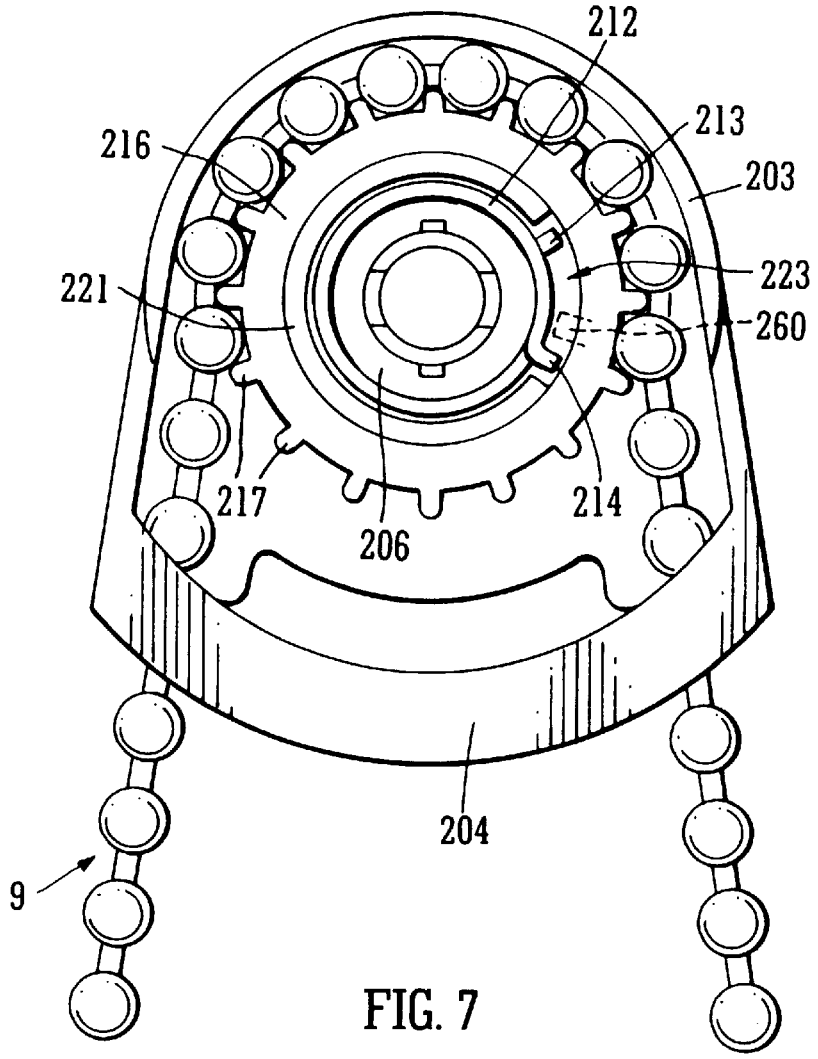
FIG. 7 is an end view of the assembly as viewed from the right in FIG. 3 but with its spigot removed.
Figure 8:
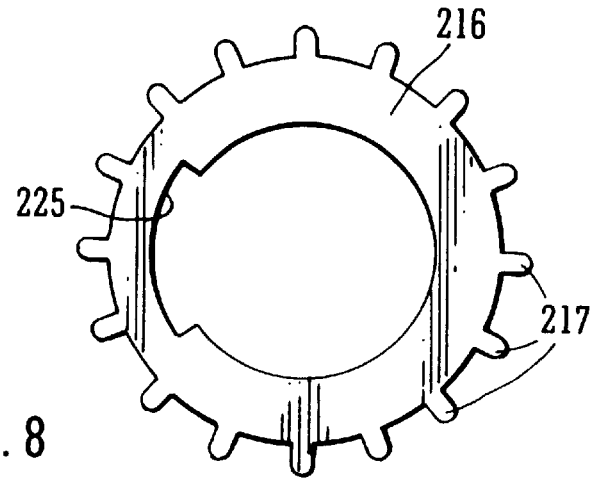
FIG. 8 is an end view of the pulley, removed from the drive assembly, as viewed from the left in FIG. 6.

As can be seen in FIG. 6, the rear wall 202 of the housing is integrally formed with a hollow cylindrical shaft 206 which projects through the open front of the housing. The inner end of the shaft 206, located partially within the side wall 203, is stepped outwardly to form an annular bearing ring 207 of enlarged diameter relative to the remainder of the shaft 206. The outer end of the shaft is stepped inwardly to form a cylindrical pin 208 which is axially slotted at 209 to form two opposed halves which can be pinched inwardly. The two halves of the pin carry opposed retaining ramps 210 and 211 which are spaced from the shaft 206, diverging in the direction of the shaft. A braking member in the form of a single coil spring 212 is mounted on the shaft 206, best seen in FIGS. 7 and 8. The spring encircles the shaft for a number of turns, the outside diameter of the turns being slightly less than the outside diameter of the bearing 207. It will be noted in FIG. 7 that the ends 213 and 214 of the spring are out-turned and circumferentially spaced, the coils of the spring having been continued for part of a turn.

Returning to FIG. 6, a pulley member 216 is fitted over the shaft 206 to be positively located and rotatably received on the inner end of the bearing ring 207 within the housing 201. The pulley is in the form of an annular ring which is closely received on the bearing 207 with radially projecting and axially aligned flat webs 217 formed at equal circumferential intervals around the periphery of the ring. The pulley thus has no cheeks, and there is a substantial gap between the outer extremities of the webs 217 and the side wall 203 so that a loop of ball cord 9 can be inserted through the bottom of the housing 201, passed over the shaft 206 and engaged around the pulley without removing the pulley from the housing.

Integral with the pulley 216 is an axially projecting drive cylinder 221 which is located about the shaft 206 with a sufficient clearance for the turns of the spring 212. The cylinder 221 contains an axial slot 223 (FIG. 7) which receives the out-turned ends 213 and 214 of the spring 212. It will be noted in FIG. 8 that the circular central aperture of the pulley 216 is recessed at 225 in registration with the slot 223 to permit free passage of the projecting ends 213 and 214 when the pulley is passed over the spring 212. Although the circumferential extent of the recess 225 is sufficient to allow the pulley to pass over the spring 212 without any requirement for rotation of the pulley it will be appreciated that the recess could be just wide enough to allow one of the projecting ends to pass through since the pulley could be rotated to successively align the ends 213 and 214 with the recess if required. Similarly, the aperture of the pulley could have two (or more) recesses circumferentially aligned with the ends 213 and 214. Another possibility would be for the outside diameter of the bearing ring to be greater than the circumferential limit of the projections 213 and 214 so that the pulley can be placed over the first projection 214 in any orientation, following which the pulley can be rotated until the projections enter the slot 223.

Referring back to FIGS. 3 in conjunction with FIG. 6, a hollow spigot 230 is received over the cylinder 221. The spigot has external splines 231 for driving connection within the end of the roller 3 (FIG. 1). The inside of the spigot 230 also has an axial rib 260 (FIG. 7) which is disposed within the slot 223 between the ends 213 and 214 of the spring 212. The outer end of the spigot 230 has an apertured end wall 234 (FIG. 6) which is retained on the pin 208 by radial end faces of the ramps 210 and 211. The spigot can however be removed when required by pinching together the two halves of the pin 208. The end wall 234 also has a short annular guide wall 235 which locates inside the cylindrical projection 221. The guide wall 235 provides positive radial location of the outer end of the cylinder 221 and, together with the bearing ring 207, ensures that the single spring 212 is correctly axially positioned on the shaft 206.

The inner end of the spigot 230 carries an outwardly projecting annular flange 236 which is recessed into the side wall 203 and substantially closes the housing 201. The flange 236 also retains the ball cord 9 within the housing and provides the drive assembly with a neat appearance. In addition, the flange 236 guards against the edge of sheet material rubbing against the pulley in use.

It will be noted in FIG. 6 that the pulley is of substantially the same thickness as the diameter of the balls carried on the cord 9 so that the cord is axially located between the rear wall 202 of the housing and the flange 236. This simplifies moulding of the pulley since it has no side cheeks, and allows a potential reduction in the overall thickness of the housing 201.

When the pulley 216 is rotated by pulling on the cord 9 one of the opposed sides of the slot 223 driveably engages the appropriate end 213 or 214 of the spring and starts to unwind the spring causing it to release its grip on the shaft 206. This rotational movement is transmitted to the spigot 230 via the internal rib, and thence to the roller. On the other hand, rotation of the spigot 230 other than by the drive cord 9 causes the internal rib to engage one of the ends 213 or 214 and starts to wind up the spring, which thus tightens its grip on the shaft 206, thereby resisting further rotation of the spigot.

During assembly the spring 212 can be placed over the shaft 206 before the pulley 216, which makes it easier to fit the braking member and generally simplifies and speeds up assembly.

The bearing ring 207 could alternatively comprise a separate collar which is located about the shaft 206 between the housing 203 and the spring 212.

Figure 9:
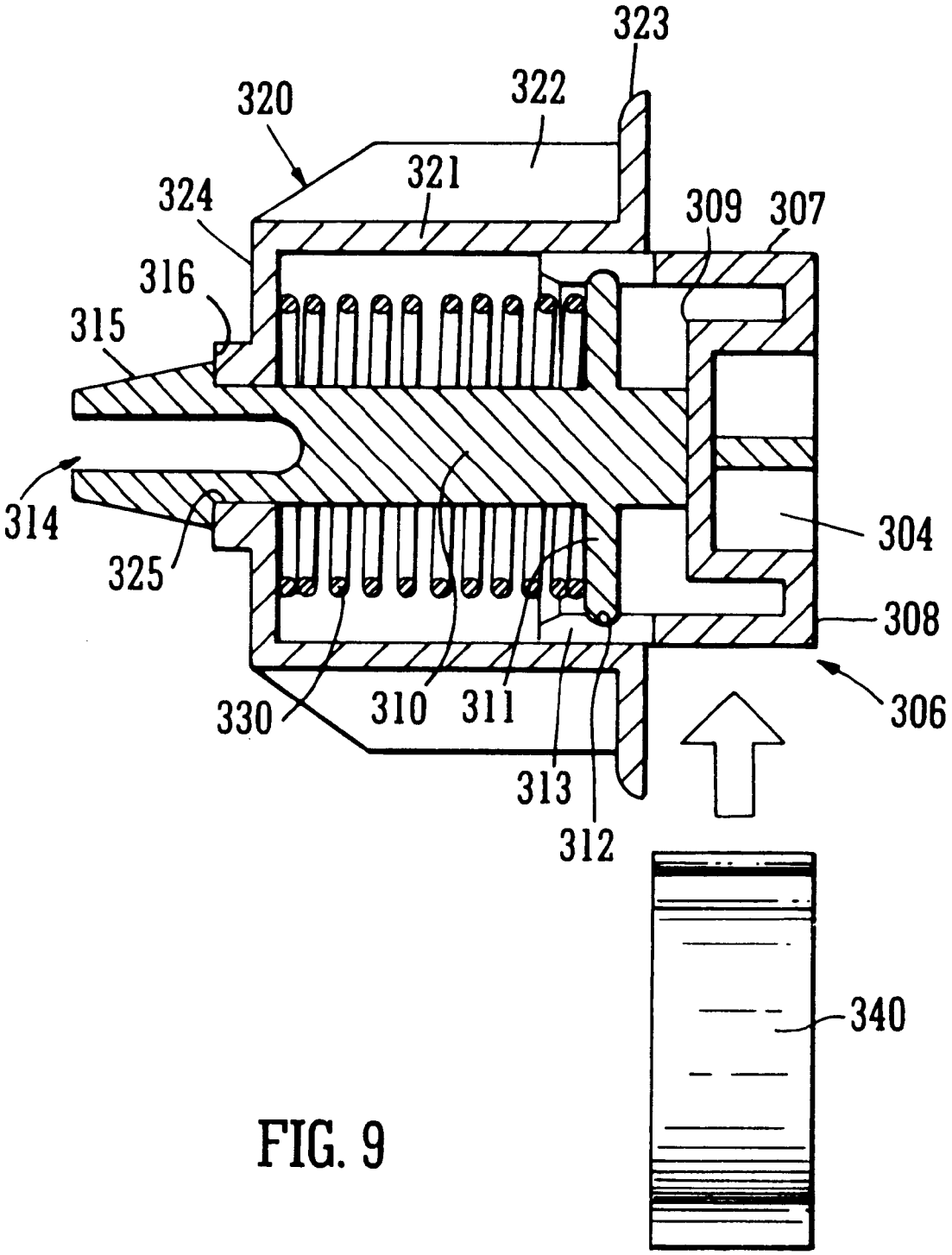
FIG. 9 is an axial section through the idle end support of the roller blind.

Referring now to FIG. 9, the idle end support assembly comprises a drum 306 which is generally cup-shaped. The drum has a cylindrical side wall 307 with one end wall 308, the opposite end being open. An aperture 304 is formed by a recessed central part of the end wall 308 which also forms a platform 309 inside the drum.

A shaft 310 is rotatably mounted in the open end of the drum 306 by means of a circular guide flange 311 which snap-engages in a groove 312 running around the inside of the drum. The drum may be axially slotted at 313 to assist in the insertion of the shaft, if desired. The internal surface of the drum could be formed with a tapered lead-in to assist with insertion of the shaft 310. The shaft is of square or other non-circular transverse cross-section. The inner end of the shaft bears against the platform 309 whilst the outer end of the shaft has an axial slot 314. On the opposite sides of the slot a pair of divergent ramps 315 lead from the end of the shaft to a pair of external retaining shoulders 316.

Figure 11:
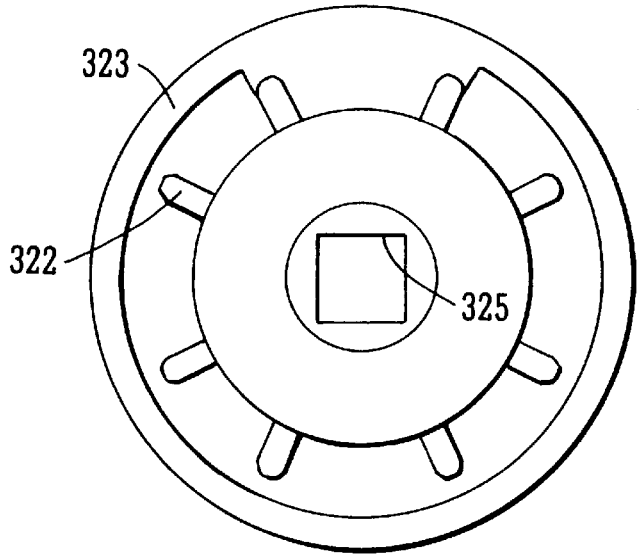
FIG. 11 is an end view of the spigot included in the idle end support, looking from the left in FIG. 9.

A cup-shaped spigot 320 is located on the shaft 310. The spigot has a cylindrical side wall 321 with external ribs or splines 322 (see FIG. 11 also) for frictional engagement in the tube 3. One end of the side wall has an external circular flange 323 for locating the end of the tube, while the other end of the spigot is closed by an end wall 324. The shaft 310 passes through a square aperture 325 in the end wall 324 so that the spigot is non-rotatably keyed onto the shaft 310. The ramps 315 cause the two sides of the shaft 310 to move together as the spigot 320 is pushed onto the shaft, and once in position the spigot is retained on the shaft by the shoulders 315. The spigot could however be easily removed if required, by squeezing the ramps together.

The open end of the spigot 320 is closely but rotatably received over the open end of the drum 306, such that the spigot is able to slide along the shaft towards the mounting bracket 7. However, a coiled compression spring 330 is located about the shaft 310 bearing against the end wall 324 of the spigot 320 and the abutment formed by the flange 311 so as to urge the spigot towards the shoulders 315, as shown.

Figure 10:
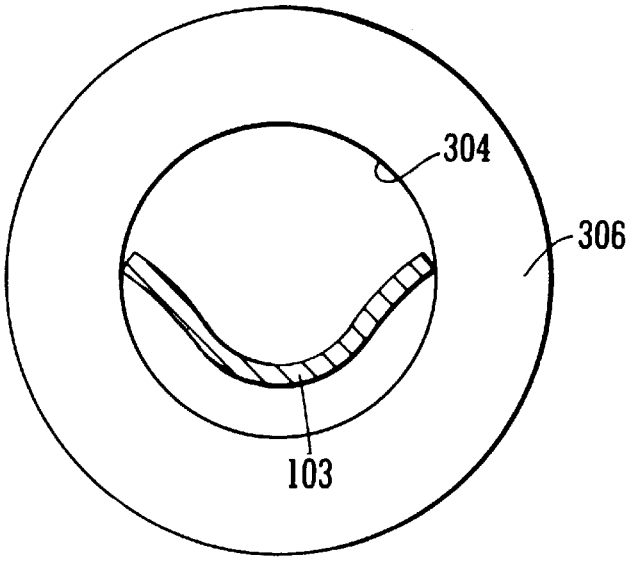
FIG. 10 is an end view of part of the idle end mounting showing, in cross section, part of the bracket engaged therewith, looking from the right in FIG. 9.

When mounting the roller blind on its supporting brackets 6 and 7 the drum 306 is first engaged with the lug 103. It will be noted in FIG. 10 that the aperture 304 is of circular cross section so that the lug 103 is not keyed to the drum 306 and the drum can therefore be engaged with the lug in any rotational position. This makes the installation of the roller blind particularly simple. In practice, there is generally a frictional engagement between the lug and the wall of the aperture 304 so that the drum 306 is, in effect, non-rotatably mounted on the bracket. After engaging the drum 306 with the lug 103 the tube 3 can be pushed towards the bracket 7 so that the spigot 320 moves over the shaft 310 and drum 306 against the action of spring 330. The drive assembly 4 can now be engaged with its respective bracket 6 in the manner described above. The tube is then released so that the spring 330 urges the spigot back towards the shoulders 315, thereby firmly holding the roller blind in position between the brackets 6 and 7. When the tube is rotated at the driven end to wind or unwind sheet material on or off the tube, the spigot 320, spring 330 and shaft 310 rotate together relative to the drum 306. There is thus no risk of the spring being wound or unwound during rotation, even though the ends of the spring may be frictionally held.

Figure 12:
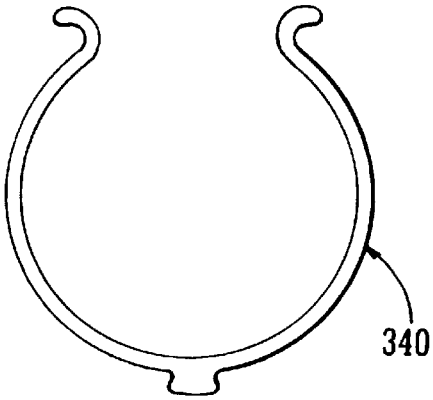
FIG. 12 is an end view of the spring clip included with the idle end support, looking from the left in FIG. 3.

The tube can of course be disengaged from the mounting brackets by a reverse process. If desired, inadvertent dislodgement of the tube can be prevented by placing a spring C-clip 340 over the drum 306, as shown in FIGS. 9 and 12, although this will usually not be necessary. It will be appreciated that the shaft 310 could be retained in the drum 306 by other means, such as a screw inserted through the platform 309.

Although formed of relatively thin metal the lugs 103 of the brackets 6 and 7 will not twist or deform as the blind is wound and unwound. Similarly, the side wall 101 will not be deformed or bend at the junction with the end wall 102 when the blind is being installed or removed.

Whilst the above description lays emphasis on those areas which, in combination, are believed to be new, protection is claimed for any inventive combination of the features disclosed herein.

What I claim is:

1. A roller blind comprising a sheet wound on a tube, including an idle end support which comprises:

a fixed portion including a hollow cylindrical portion having first and second ends;

a shaft rotatably mounted within said hollow cylindrical portion to project from said first end thereof;

a hollow spigot mounted on said shaft for engagement within an end of said tube and keyed to said shaft for rotation therewith, said spigot being axially slidable relative to said shaft, with an end of said spigot slidably located about said hollow cylindrical portion; and spring means acting between the spigot and the shaft to axially urge the spigot away from the fixed portion.

2. A roller blind according to claim 1, in which the shaft is keyed to a transverse end wall of the spigot and said spring means acts against said transverse end wall.

3. A roller blind according to claim 1, in which said spring means acts against an outwardly projecting flange which is formed on said shaft and located within said hollow cylindrical portion.

4. A roller blind according to claim 3, in which said flange is retained within said hollow cylindrical portion by snap-engagement therein.

5. A roller blind according to claim 4, in which said flange is snap-engaged in an internal groove formed in said first end of the hollow cylindrical portion.

6. A roller blind according to claim 4, in which said first end of the hollow cylindrical portion comprises an axial slot.

7. A roller blind according to claim 1, in which said hollow cylindrical portion has an internal transverse wall.

8. A roller blind according to claim 7, in which one end of the shaft rotates in contact with said transverse wall.

9. A roller blind according to claim 1, in which the second end of said hollow cylindrical portion contains an end opening, and said fixed portion comprises a mounting bracket formed with a lug for insertion into said end opening.

10. A roller blind according to claim 9, in which said hollow cylindrical portion has an internal transverse wall and said opening is defined by said transverse wall and an internal axially-extending wall within said hollow cylindrical portion.

11. A roller blind according to claim 10, in which said internal wall is joined to said hollow cylindrical portion by an end wall.

12. The roller blind of claim 1, additionally including a mounting bracket which is formed from sheet metal and comprises a side wall, an end wall, and a connecting lug for connection with a component which supports the tube, the end wall and the connecting lug projecting substantially perpendicularly from the side wall and the lug having a root forming the junction with the side wall, the junction extending in a non-linear configuration along the lug and the side wall.

13. A roller blind according to claim 12, in which the lug is formed with a rib which extends substantially perpendicularly from the root of the lug at the junction with the side wall.

14. A roller blind according to claim 13, in which said rib is of arcuate shape.

15. A roller blind of claim 1, additionally including a mounting bracket which is formed from sheet metal and comprises a side wall and an end wall which projects substantially perpendicularly from the side wall, the side wall having connecting means for connection with a component which supports the tube, the junction between the side wall and the end wall extending therealong in a non-linear configuration.

16. A roller blind according to claim 15, in which the side wall is formed with at least one rib which extends from the junction between the said walls.

17. A roller blind according to claim 16, in which the side wall is formed with a plurality of such ribs which extend to the opposite edge of the side wall.

18. A roller blind according to claim 15, in which the end wall is formed with at least one rib which extends from the junction between the said walls.

19. A roller blind according to claim 15, in which said connecting means comprises a connecting lug which extends from a substantially flat area of the side wall.

20. A roller blind comprising a sheet wound on a tube, including a drive assembly which comprises:

a housing which is open in the direction of the tube and contains a shaft which projects therefrom;

a braking member which encircles the shaft, said braking member having a pair of circumferentially spaced ends;

a pulley which is rotatably mounted about the shaft within the housing and which includes a cylindrical portion located about the shaft and containing an axial slot, wall portions of the cylindrical member on opposite sides of the slot each being driveably engageable with a respective end of the braking member;

a spigot for connection with the tube received over said cylindrical portion and having projection means which is disposed within the said slot between said ends of the braking member; and a flexible drive element looped around the pulley for rotation thereof; the arrangement being such that rotation of the pulley by means of the drive element causes the cylindrical portion to act on the braking member causing it to release its grip on the shaft, such rotational movement being transmitted to the spigot via the projection means, and rotation of the spigot other than by the drive element causes the said projection means to act on the braking member such as to tighten its grip on the shaft and thereby resist rotation of the spigot;

in which the shaft carries bearing means for positively and rotatably locating the pulley thereon, said bearing means being of greater outside diameter than the portion of the shaft which receives the braking member, the pulley having an internal bearing surface for co-operation with the bearing means and which is configured such that the pulley can pass over the braking member during assembly thereof.

21. A roller blind according to claim 20, in which the pulley has a bearing surface provided by a central aperture which is substantially circular with at least one recess for passage of the ends of the braking member.

22. A roller blind according to claim 20, in which the shaft is stepped such that the bearing means is formed by an enlarged portion of the shaft.

23. A roller blind according to claim 20, in which the pulley has an outermost diameter disposed with substantial radial clearance from the opposed wall of the housing, such that the drive element can be engaged with the pulley whilst the pulley is located in the housing.

24. A roller blind according to claim 20, in which the spigot carries a radially projecting annular flange which substantially closes the housing.

25. A roller blind according to claim 24, in which the drive element comprises a series of balls.

26. A roller blind according to claim 25, in which the pulley is of substantially the same thickness as the diameter of the balls so that the drive cord is located in one axial direction by the wall of the housing and in the opposite direction by the flange of the spigot.

* * * * *